United States Patent [19]

Naylor

[11] 3,932,985

[45] Jan. 20, 1976

[54] YARN FRICTION FALSE TWIST DEVICE

[75] Inventor: Geoffrey Naylor, Macclesfield, England

[73] Assignee: Ernest Scragg & Sons Limited, Macclesfield, England

[22] Filed: Nov. 4, 1974

[21] Appl. No.: 520,891

[30] Foreign Application Priority Data

Nov. 3, 1973 United Kingdom ..... 51135/73

[52] U.S. Cl. ..... 57/77.4; 57/77.45

[51] Int. Cl.[2] ..... D01H 7/92; D02G 1/04

[58] Field of Search ..... 57/77.3–77.45

[56] References Cited

UNITED STATES PATENTS

| | | | |
|---|---|---|---|
| 2,923,121 | 2/1960 | Tully | 57/77.4 |
| 3,287,890 | 11/1966 | McIntosh et al. | 57/77.4 |
| 3,762,149 | 10/1973 | Raschle | 57/77.4 |
| 3,820,317 | 6/1974 | Raschle | 57/77.4 |
| 3,872,661 | 3/1975 | Eaves | 57/77.4 |

*Primary Examiner*—Donald E. Watkins
*Attorney, Agent, or Firm*—Michael J. Striker

[57] ABSTRACT

Friction false twist device is of the class comprising three parallel equiangularly spaced shafts each having a set of equally axially spaced friction discs, the discs of the sets being arranged so that they overlap substantially when viewed axially and a strand passing through the centre of the device follows a zig-zag spiralling path from one disc rim to the next. The improvement comprises having one set of discs as a datum set with its shaft fixed to a support member with a flat reference surface from which the shaft projects. The two other shafts are carried on respective pivotal arms each with a flat undersurface seated on the flat reference surface of the support and the distance between the shaft axis and a pivot axis of the arm is the same for both shafts. The pivot axes of the two arms are equally spaced from each other and from the shaft axis of the datum set of discs, so that the distances between the latter axis and the axes of the two other shafts can be adjusted while keeping equal spacings.

10 Claims, 5 Drawing Figures

FIG. 2
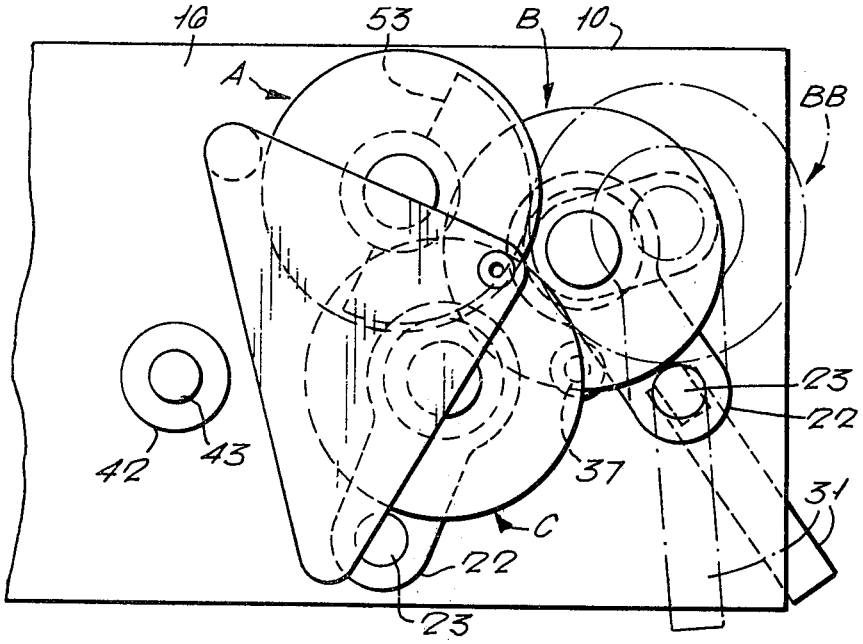
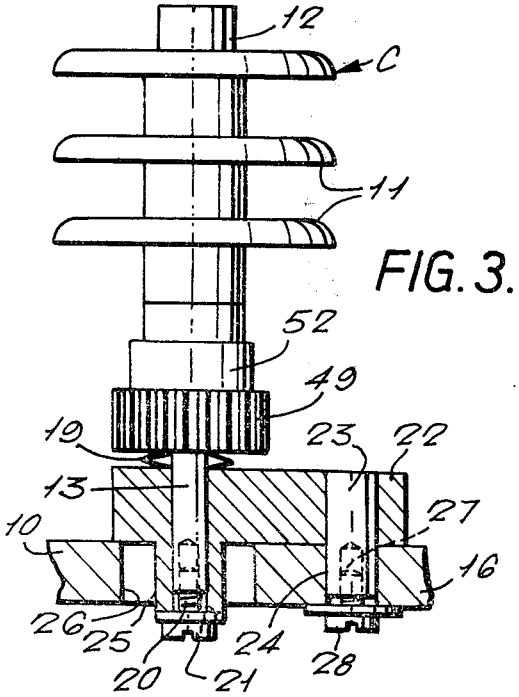
FIG. 3.

FIG. 4.
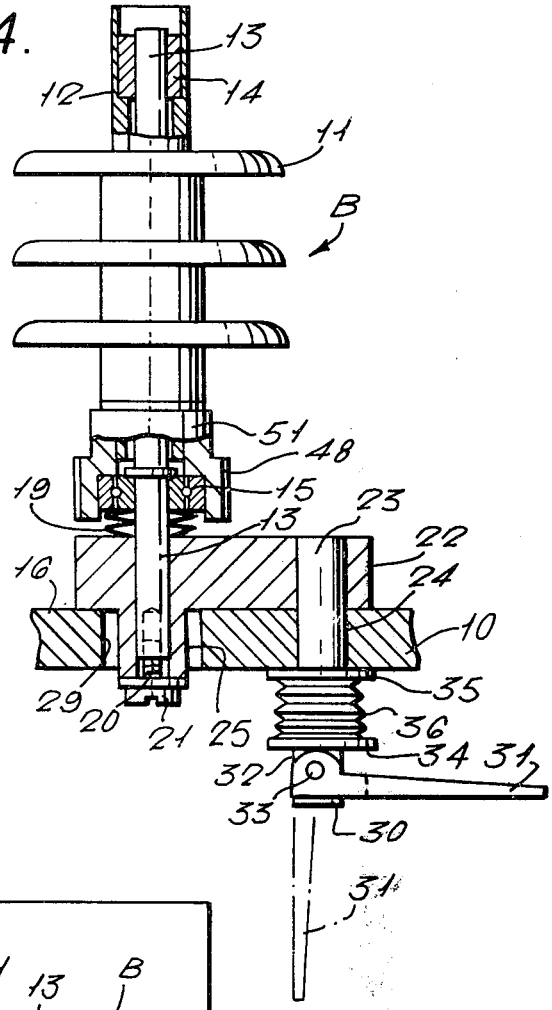
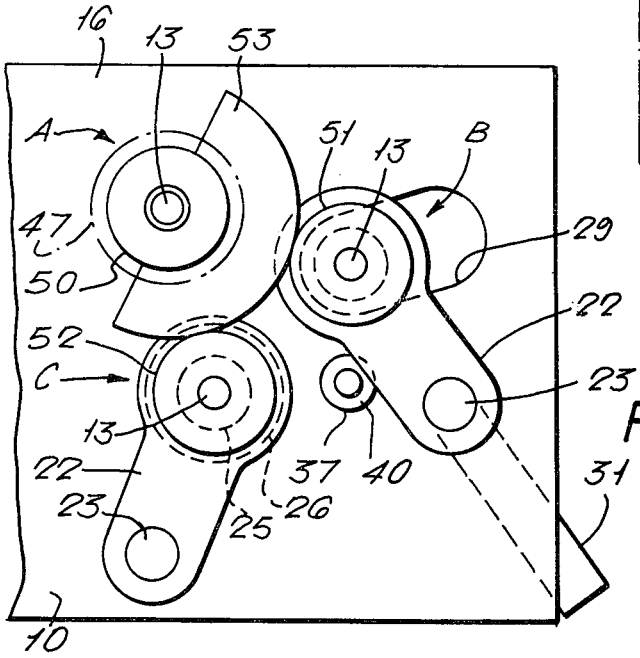
FIG. 5.

YARN FRICTION FALSE TWIST DEVICE

This invention relates to friction false twist devices of the kind in which a plurality of overlapping rotary discs are arranged on axes disposed about a strand path in such manner that the running strand contacts the rim of each disc in turn and is false twisted by being rotated by frictional contact with the moving rims as the discs rotate all in the same direction. We have found that by suitably positioning the discs with respect to one another, the strand is caused to travel over each disc rim at an angle inclined to the plane of rotation of the disc so that it is rotated with a substantially pure rolling motion on the disc rim, substantially without slip. In this way, the twist impartation becomes independent of the variations of frictional effect usually associated with friction twisting, in which there has hitherto been substantial slip between strand and friction surface. Consequently, a very precise and positive control of the twisting operation results, giving a surprisingly regular texturing effect in false twist crimping strands such as yarns of synthetic polymeric materials.

A typical device of the kind to which this invention relates, comprises three parallel, equiangularly spaced shafts each having a set of three discs with rubber or polyurethane tyres or rims, all of equal radius and equally axially spaced, and arranged so that they overlap one another substantially when viewed axially. The discs are so axially spaced and overlapped that a strand passing through the centre of the device follows a zigzag spiralling path and lies on the friction surface of each tyre at an angle to the direction of motion of the surface equal, or substantially equal, to the desired twist angle, and in this manner the pure rolling motion is achieved.

In order that the device can be made to operate under optimum conditions for yarn of a given denier and for yarns of different deniers or other variable properties or characteristics, it is desirable that the device should be adjustable both as to the spacing between the axes of the shafts, which governs the amount of overlap of the discs, and as to the axial spacing of the discs one from another being equal for all the discs of the device.

We have already proposed to provide that all three shafts should be adjustable for varying the spacing of their axes while maintaining equal spacing, but mechanisms for effecting such adjustments tend to be complicated and beset by the problems of engineering tolerances in manufacture, with the result that it becomes very difficult to provide multiple devices, for the many stations of a multi-station false twist crimping machine, which all process yarn substantially identically and without significant variations between yarns processed by the respective devices. The present invention is therefore concerned with such a friction false twist device in which provision is made for varying the spacing of the shaft axes while maintaining equal spacing, in a very simple manner which also greatly reduces the problems of engineering tolerances. The invention is also concerned with providing for adjustment of the axial spacings of the discs, again in a very simple manner, and further with providing that one set of discs is movable away from the others by such a distance that the device can readily be threaded up with yarn by entering the yarn from the side of the device.

The invention is based on the concept that one of the sets of discs is a datum set and is mounted on a support member with its shaft projecting relative to a flat reference surface of the support member and with its shaft axis at a location which is fixed relative to the parallel axes of the shafts of the other two sets of discs, the latter shafts being carried on respective pivotal members each having a flat undersurface seated upon the flat reference surface of the support member or a surface co-planar therewith, and the shafts being mounted on the pivotal members with their axes equally spaced from fixed axes about which the pivotal members are adjustable, the latter axes being equally spaced from each other and from the shaft axis of the datum set of discs, and means being provided for locking the pivotal members in selected positions of adjustment.

Preferably the shaft of the datum set of discs has its axis perpendicular to the reference surface.

Further according to the invention at least two of the shafts are so mounted as to be adjustable in their axial directions, as by screw mechanisms operating in conjunction with shaft loading springs.

In another feature of the invention at least one of the pivotal members is pivotally adjustable to such an extent that the set of discs on the shaft which it carries can be brought into and out of overlapping relationship with the sets of discs of the other two shafts, and the support member may be provided with an adjustable stop which predetermines an inward adjusted position of the pivotal member when the set of discs on the shaft which it carries are in overlapping relationship with the sets of discs of the other two shafts, and in these connections the adjustable stop may be an abutment with a conical nose, located in the support member to have its nose in the path of pivotal adjustment of the pivotal member, the abutment being adjustable in the direction of its length as by a screw mechanism, the pivotal member being provided with a handle movable in one sense to apply or release the locking means for the pivotal member and movable in a different sense to pivotally adjust the pivotal member and its shaft.

In devices of the kind to which this invention relates, it is usual to have all the discs provided with rubber or polyurethane tyres or rims, and we have further proposed to provide the device as a whole with additional endmost discs of metal which have a guiding function. The manufacture of metal discs of precise dimensions is much easier than the manufacture to precise dimensions of discs with moulded rubber or polyurethane tyres or rims. We have discovered that for efficient false twisting with these devices it is not essential that there should be as many as nine discs with rubber or polyurethane tyres or rims, and experiment has indicated that five such discs are sufficient.

Therefore according to another feature of the invention, in the datum set of discs the discs are all of metal, or of hard synthetic resin material such as acetyl resin, or of glass fibre reinforced synthetic resin, and preferably the other two sets of discs have all their discs formed with rubber or polyurethane tyres or rims.

An embodiment of the invention will now be described with reference to the accompanying diagrammatic drawings in which:

FIG. 2 is a diagrammatic plan view.

FIGS. 3 and 4 are diagrammatic side views, partly in section, showing details of two of the individual sets of discs of the device.

FIG. 5 is a diagrammatic plan view illustrating adjustment of the device by means of a setting gauge.

Figure 1:
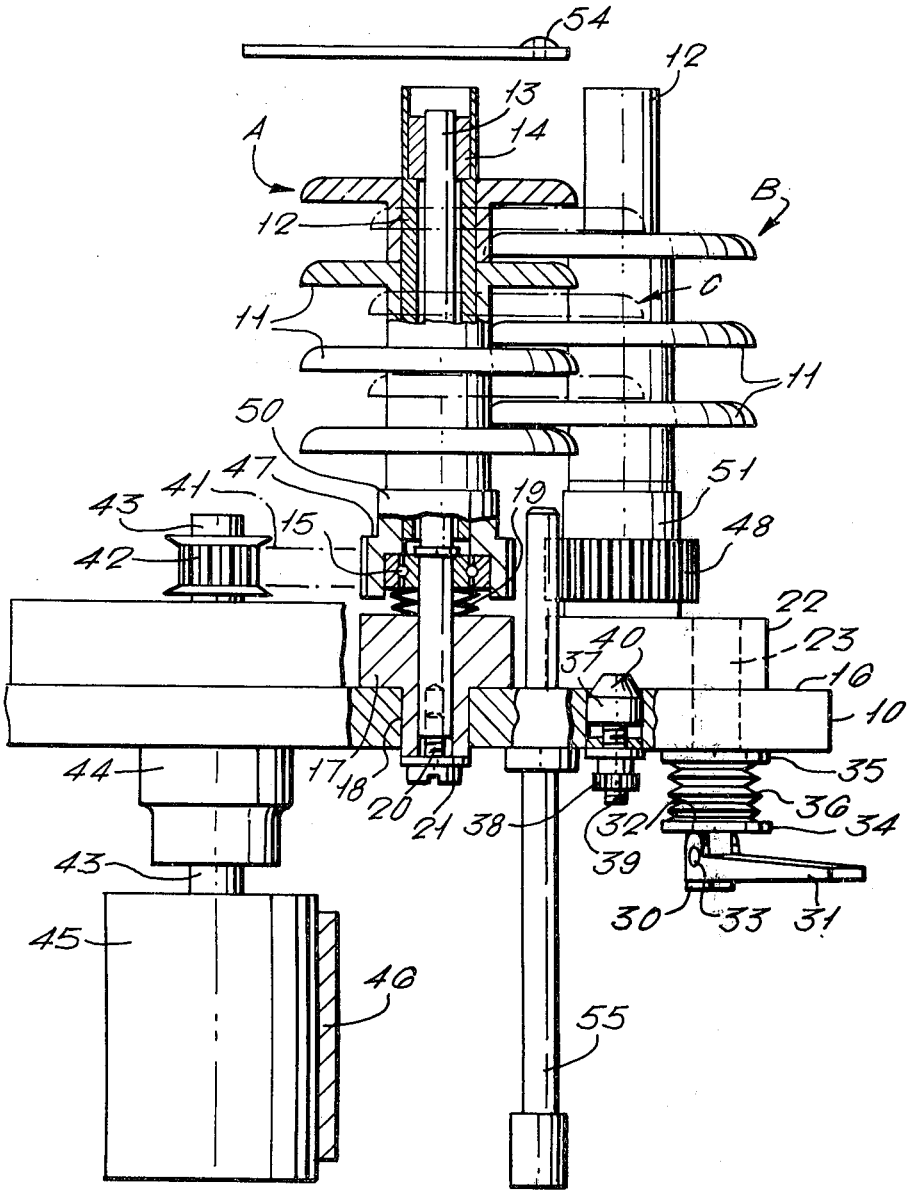
FIG. 1 is a diagrammatic side elevation, partly in section, of a friction false twisting device constructed according to the invention.

Referring to the FIGS. 1 and 2 of the drawings, the friction false twist device comprises a support member in the form of a base plate 10 which affords a bracket or mounting for the device as a unit, and in manner hereafter described supports three sets A, B and C of friction discs 11, all of which may have polyurethane rims or tyres. The discs of each set are assembled as a group fixed to, and equally spaced apart axially along, a sleeve 12 rotatable about a fixed shaft 13 via a top plain bearing 14 and a bottom ball bearing 15. All the shafts 13 are parallel with each other.

The important feature concerning the base plate 10 is that its upper surface 16 is a flat reference surface, relative to which all the shafts 13 of the disc sets project, preferably perpendicularly as illustrated although this need not be so since the main requirement is that the shafts are parallel.

The set of discs A is a datum set, being mounted on the base plate 10 with the axis of its shaft 13 at a fixed location relative to the shafts of the other two sets. As seen in FIG. 1, the bottom end portion of the shaft 13 of this datum set is slidably located in a bush member 17 fixed in an accurately drilled bore 18 in the base plate. Between the upper face of the bush member 17 and the underside of the bottom ball bearing 15 is a stack of bow spring washers 19, which thus is tending to urge the shaft 13 upwardly relative to the bush member 17 and the base plate 10. Screw-threaded into a blind bore in the bottom end of the shaft 13 is an adjusting screw 20, which projects into the bore of the bush member 17 and has an enlarged head 21 which seats on the bottom end of the bush member. The shaft 13 and its set of discs can therefore be adjusted bodily in the axial direction of the shaft by rotating the screw 20.

The other two sets of discs B and C are, in exactly the same way as set A, assembled on sleeves 12 rotatable about shafts 13 on a plain top bearing 14 and a bottom ball bearing 15. However, the shafts of disc sets B and C are carried on respective similar pivotal members in the form of pivotal arms 22 each having a flat undersurface 23 seated upon the flat reference surface 16 of the base plate 10, the arms 22 each carrying near one end a pivot pin 23 rotatable in an accurately drilled bore 24 in the base plate 10. An important feature of the invention is that the axes of the pivot pins 23 are at equal distances from each other and from the axis of the fixed shaft 13 of the disc set A.

The shafts 13 of the disc sets B and C (FIGS. 3 and 4) are slidable axially in accurately drilled bores near the other ends of the pivot arms 22, and another important feature of the invention is that the shafts 13 are mounted on the pivot arms 22 with their axes equally spaced from the fixed axes of the pivot pins 23 about which the arms are pivotal adjustable, as seen most clearly in FIGS. 2 and 5.

Referring to FIG. 3, the underside of the pivot arm 22 of disc set C has an integral depending bush 25, the bore of which forms an extension of the bore in the arm for the shaft 13, which also extends into the bush bore. It will be noted that, as for disc set A, a pack of bow spring washers 19 is between the upper face of the pivot arm 22 and the underside of the bottom ball bearing for the shaft 13, and a similar adjusting screw 20 with enlarged head 21 provides for axial adjustment of the shaft 13 and the disc set C. The bush 25 is located in a circular clearance hole 26, in the base plate, which is of large enough diameter to permit pivotal adjustment of the arm 22 over an angle of about 20°. The bottom end of the pivot pin 23 does not reach the bottom end of the bore 24 in the base plate 10, and projecting into the bottom end of the bore is a locking screw 27 which screws into a blind bore in the end of the pivot pin and has an enlarged head 28 engaging the underside of the base plate. The screw 28 is untightened to release the arm 22 for pivotal adjustment to vary disc overlap, and then re-tightened to lock the arm.

Referring to FIG. 4, the underside of the pivot arm 22 of disc set B also has an integral depending bush 25 with a bore forming an extension of the bore in the arm for the shaft 13, which also extends into the bush bore. As for disc set C, a pack of spring washers 19 is between the upper face of the pivot arm 22 and the bottom ball bearing 15 for the shaft 13, and a similar adjusting screw 20 with enlarged head 21 provides for axial adjustment of the shaft 13 and the disc set B. The bush 25 is located in an elongated slot 29 in the base plate 10 (see also FIG. 5), of such length as to permit pivotal adjustment of the arm 22 over a wide angle of sufficient extent to bring the discs of Set B out of overlapping relationship with discs of sets A and C, as illustrated in phantom lines in FIG. 1 at BB. This allows the device to be threaded up with yarn from the side.

Also as shown in FIGS. 1 and 4, the pivot pin 23 of the pivot arm 22 of disc set B extends completely through the base plate 10 to project at its underside as a bottom extension 30 on which a lever 31 with a bifurcated cam nose 32 is pivoted at 33. Above the lever nose 32 is a first washer 34 encircling the pivot pin extension, and this washer is spaced from a second similar washer 35, in contact with the underside of the base plate 10, by a stack of bow spring washers 36. When the lever 31 is in the horizontal position shown in FIGS. 1 and 4, the loading of the bow spring washers 36 is relieved by the cam nose 32 of the lever sufficiently for the pivot arm 22 to be moved to swing the disc set B outwardly away from sets A and C, and inwardly back again, with the lever 31 forming a convenient handle. When the lever 31 is swung downwardly to a vertical position, as indicated in phantom lines in FIG. 4 a high portion of the cam nose 32 raises the washer 34, compresses the springs 36, and clamps the top washer 35 against the underside of the base plate 10 to lock the pivot arm 22.

An adjustable stop is provided on the base plate for defining the inwardly-swung limit position of the disc set B and its pivot arm 22. This stop is shown most clearly in FIG. 1, in the form of an abutment 37 slidably adjustable axially in a blind bore in the base plate 10, by means of a rotatable nut 38 below the base plate which is threaded on a screw shaft 39, depending axially from the abutment 37, and passing through a clearance hole at the base of the blind hole in which the abutment slides. The upper nose portion 40 of the abutment is conical, and it is this conical nose which is in the path of adjustment of the pivot arm 22 and provides an adjustable stop.

The disc sets A, B and C are all driven to rotate in the same direction by a toothed driving belt indicated in a phantom line at 41 in FIG. 1. This belt is driven by a toothed pinion 42 fixed to a shaft 43 journalled at 44 in a reinforced region of the base plate 10. The shaft 43 has fixed to it a cylindrical wharve 45 engaged by a drive belt 46.

The disc sets A, B and C each carry a respective toothed pinion 47, 48 and 49 for engagement by the driving belt 41. The teeth of these pinions are longer than the width of the driving belt 41 to accommodate the axial adjustment of the disc sets and their shafts previously described. The pinions 47, 48 and 49 are identical, especially as regards the diameter of a cylindrical upper bush portion 50, 51 and 52 of the respective pinions, since in this embodiment the surfaces of these bush portions are utilised as reference surfaces in setting up the device with the axes of the shafts 13 of the disc sets at equal predetermined spacing, so that the discs then overlap one another by equal predetermined amounts.

The setting up operation is effected by means of the annular semi-circular gauge or distance piece indicated at 53 in FIGS. 1 and 2, which needless to say is very accurately made and of which there may be several of different sizes, each appropriate for setting up the device to process yarns of particular deniers and/or other characteristics and each preferably marked accordingly.

As seen most clearly in FIG. 5, the gauge or distance piece is located with its inner concave side seating on the reference surface 50 of pinion 47 of disc set A, which is the fixed datum set of discs. Disc set C is then set up by releasing its lock screw 27 (FIG. 3) and swinging its pivot arm 22 inwardly, until the reference surface 52 of its pinion 49 engages the outer convex side of the gauge 53, whereupon the lock screw 27 is re-tightened to lock the pivot arm 22.

Disc set B is then set up by firstly screwing back the adjustable abutment 37 to retract its conical nose, and with the lever 31 in its horizontal unlock position, using the lever to swing the pivot arm 22 of disc set B inwardly until the reference surface 51 of its pinion 48 engages the outer convex side of the gauge 53, whereupon the lever is pivoted downwardly into its vertical lock position, as already described above with reference to FIG. 4. The adjustable abutment 37 is then screwed forward again until its conical nose makes contact with one side of the pivot arm 22. Thus when the wheel set B is swung outwardly, for threading up the device, it need then only be swung back inwardly until its pivot arm 22 re-contacts the stop formed by the conical nose of the abutment, and is then re-located in its set up position.

The spacing between adjacent discs of the three sets is then checked for distance and equality, as by a feeler or slip gauge, and if unequal can be brought to equality by vertical adjustment of one or other of the discs sets by the adjusting screws 20. In this embodiment all the disc sets have a height adjusting screw 20, but it will be appreciated that one set need not have this adjustment (for example datum set A) since adjustment of the other two sets is sufficient.

In the datum set of discs A, as previously mentioned, the axially outermost two end discs of the set of four (seen in FIG. 1), can be of metal to have a guide function, and since metal is easier to machine to precise dimensions than is moulded rubber or polyurethane, it is proposed as another feature of this invention to have all the discs 11 of set A made of metal.

FIG. 1 shows a top yarn guide eye 54 and a bottom yarn tube 55 for yarn (not shown) running through the device from top to bottom and over the rims of the overlapping discs 11, the tube 55 also guarding the yarn from the drive belt 46.

What is claimed is:

1. Friction false twist device of the class comprising three equiangularly spaced parallel shafts each having a set of rotary friction discs equally axially spaced and arranged so that discs of the sets overlap one another substantially when viewed axially and a strand passing through the centre of the device follows a zig-zag spiralling path as it contacts the rim of each disc in turn, wherein one of the sets of discs is a datum set and is mounted on a support member with its shaft projecting relative to a flat reference surface of the support member and with its shaft axis at a location which is fixed relative to the parallel axes of the shafts of the other two sets of discs, the latter shafts being carried on respective pivotal members each having a flat undersurface seated upon the flat reference surface of the support member or a surface co-planar therewith, and the shafts being mounted on the pivotal members with their axes equally spaced from fixed axes about which the pivotal members are adjustable, the latter axes being equally spaced from each other and from the shaft axis of the datum set of discs, and means being provided for locking the pivotal members in selected positions of adjustment.

2. Friction false twist device according to claim 1, wherein the datum set of discs has its shaft axis perpendicular to the reference surface.

3. Friction false twist device according to claim 1, wherein at least two of the shafts are so mounted as to be adjustable in their axial directions.

4. Friction false twist device according to claim 3, wherein the shafts are adjustable by screw mechanisms operating in conjunction with shaft loading springs.

5. Friction false twist device according to claim 4, wherein at least one of the pivotal members is pivotally adjustable to such an extent that the set of discs on the shaft which it carries can be brought into and out of overlapping relationship with the sets of discs of the other two shafts.

6. Friction false twist device according to claim 5, wherein the support member is provided with an adjustable stop which predetermines an inward adjusted position of the pivotal member when the set of discs on the shaft which it carries are in overlapping relationship with the sets of discs of the other two shafts.

7. Friction false twist device according to claim 6, wherein the adjustable stop is an abutment with a conical nose located in the support member to have its nose in the path of pivotal adjustment of the pivotal member, the abutment being adjustable in the direction of its length as by a screw mechanism.

8. Friction false twist device according to claim 7, wherein the pivotal member is provided with a handle movable to apply or release the locking means for the pivotal member and also to pivotally adjust the pivotal member and its shaft.

9. Friction false twist device according to claim 1, wherein each set of discs comprises a group of discs assembled upon and fixed to a sleeve rotatable about the shaft via a plain bearing adjacent the shaft tip end and a ball bearing adjacent the shaft root end.

10. Friction false twist device according to claim 1, wherein each set of friction discs incorporates means defining a reference surface usable in conjunction with a gauge for setting equality of spacing of the axes of the disc sets by adjustment of the pivotal members.

* * * * *